United States Patent [19]

Talend

[11] Patent Number: 4,863,401

[45] Date of Patent: Sep. 5, 1989

[54] ELECTRICAL CONTACT PLUG WITH A METAL HOUSING

[75] Inventor: Donald R. Talend, Wauconda, Ill.

[73] Assignee: Corcom, Inc., Libertyville, Ill.

[21] Appl. No.: 164,857

[22] Filed: Mar. 7, 1988

[51] Int. Cl.[4] ..... H01R 9/03

[52] U.S. Cl. ..... 439/610; 439/904

[58] Field of Search ..... 439/607-610, 439/901-906, 98, 99, 578-585

[56] References Cited

U.S. PATENT DOCUMENTS 3,761,869 9/1973 Hardesty et al. .
3,954,320 5/1976 Hardesty .
4,054,350 10/1977 Hardesty .
4,678,121 7/1987 Douty et al. ..... 439/660
4,695,115 9/1987 Talend .
4,713,023 12/1987 Bixler et al. ..... 439/393
4,761,147 8/1988 Gauthier ..... 439/607

*Primary Examiner*—David Pirlot
*Attorney, Agent, or Firm*—Hill, Van Santen, Steadman & Simpson

[57] ABSTRACT

An electrical contact plug which includes a ferrite through which an input or output cable passes and which utilizes a metal cover for holding the plug assembly together such that the metal housing also provides a grounding arrangement wherein the plug portion can be connected to ground through the cable shield of a shielded cable.

1 Claim, 2 Drawing Sheets

ELECTRICAL CONTACT PLUG WITH A METAL HOUSINGCROSS-REFERENCES TO RELATED APPLICATIONS

This application is related to Ser. No. 112,548, filed Oct. 26, 1987 entitled "Electrical Contact Plug" assigned to the assignee of the present application.

BACKGROUND OF THE INVENTION

1. Field of the Invention

This invention relates in general to electrical plugs and in particularly to a grounded metal covered plug which fits into a female RJ jack.

2. Description of the Prior Art

Modular electrical contact such as jacks and plugs have been used in telephone and other equipment and are shown in U.S. Pat. No. 4,695,115 entitled "Telephone Connector With Bypass Capacitor" assigned to the assignee of the present application. See also U.S. Pat. Nos. 4,054,350, 3,954,320 and 3,761,869. The plug assembly disclosed in application Ser. No. 112,548 is formed of two parts comprising a ferrite plug end and a ferrite sleeve wherein the plug and sleeve are connected together with a suitable adhesive.

SUMMARY OF THE INVENTION

It is an object of the present invention to provide an electrical contact plug formed of three separate parts comprising a plastic plug end, a ferrite sleeve and a metal housing. The plug end and ferrite are inserted into the housing where there are retained by the plug flange and ears formed on the housing. The method of the invention eliminates the use of adhesives and provides a stronger assembly than the prior art.

It is also an object of the invention to provide a ferrite plug which has a method of grounding the metal housing to a shielded cable and to ground the cable shield to mating RJ female jack. The metal housing is electrically connected to the shielded cable.

Other objects, features and advantages of the invention will be apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
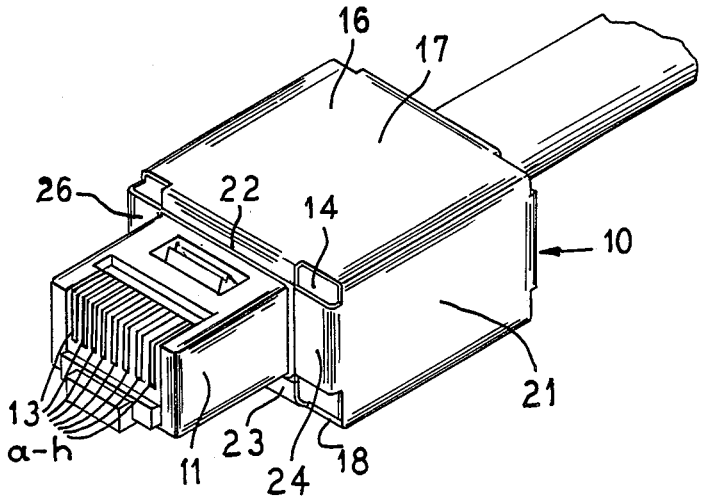
FIG. 1 is a perspective view of the electrical plug of the invention.
Figure 2:
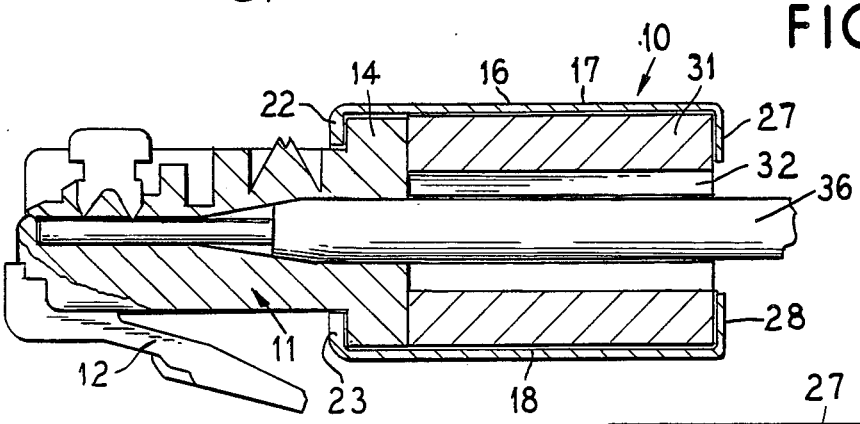
FIG. 2 is a sectional view through the plug of FIG. 1.
Figure 3:
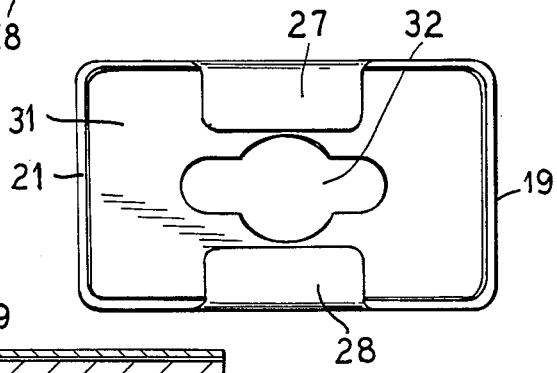
FIG. 3 is a rear view of the plug.
Figure 4:
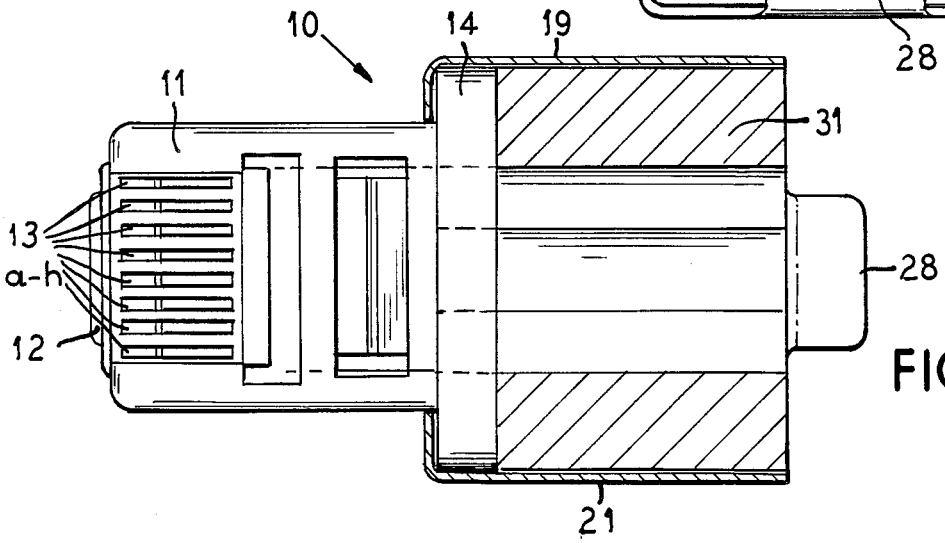
FIG. 4 is a top sectional view of the plug of FIG. 1.

FIGS. 1–4 illustrate a first embodiment of the plug of the invention. The plug 10 has a plastic plug portion 11 which is provided with a plurality of electrical contacts 13*a* through h formed in slots of the plug 11. A pivoted release lever 12 is attached to the plug 11 so as to allow the electrical plug 10 to be inserted into a mating female connector and to be locked therein. A rear portion of the plug 11 is formed with a shoulder portion 14 of enlarged dimensions and a metal housing 16 is formed with a top 17, a bottom 18 and side walls 19 and 21 and has four bent down tabs 22, 23, 24 and 26 on its front portion. The plastic plug 11 can be inserted into the housing 16 such that the shoulder 14 bears against the bent down portions 22, 23, 24 and 26 after which a hollow ferrite sleeve 31 can be inserted into the housing 16 as shown, for example, in FIGS. 2, 3 and 4 after which the tabs 27 and 28 can be bent down as shown in FIGS. 2 and 3 to lock the assembly together. The ferrite sleeve 31 bears against the shoulder 14 of the plastic member 11 as shown in FIGS. 2 and 4. The ferrite core 31 is formed with an opening 32 of the shape shown in FIG. 3 so that either a flat or round cable 36 can be connected to the electrical contacts 13*a–h*. The plug illustrated in FIGS. 1–4 provides a sturdy and reliable electrical plug and the housing 16 holds the assembly tightly together.

A modification of the invention is illustrated in FIGS. 5–8 wherein an electrical plug 50 has a plastic plug portion 52 with electrical contacts 52*a–h*. The plastic plug portion has a release lever 53 which is pivoted thereto so as to lock and unlock the plug 50 from a mating female socket.

Figure 5:
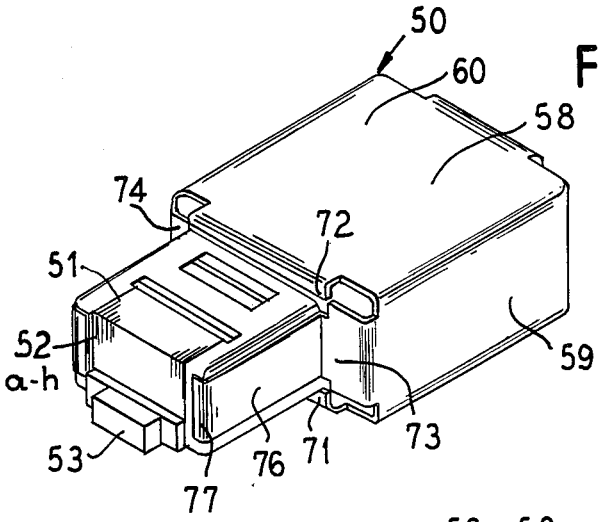
FIG. 5 illustrates a modification of the plug of the invention.
Figure 6:
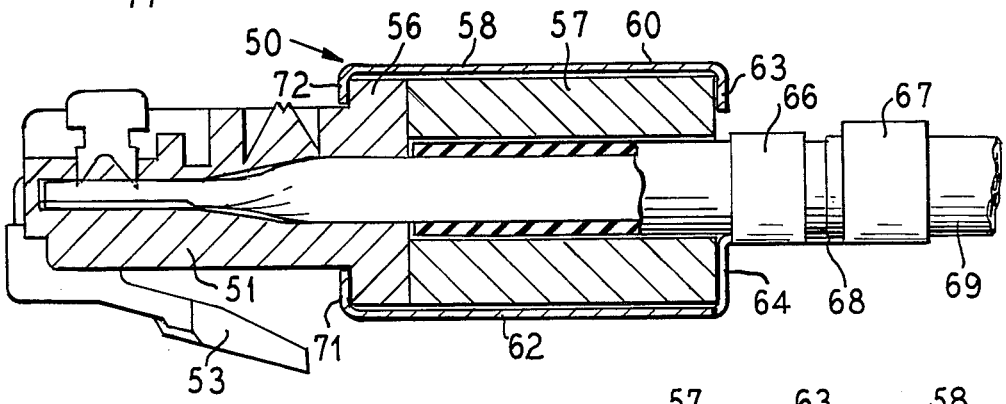
FIG. 6 is a sectional view through the plug of FIG. 5.
Figure 7:
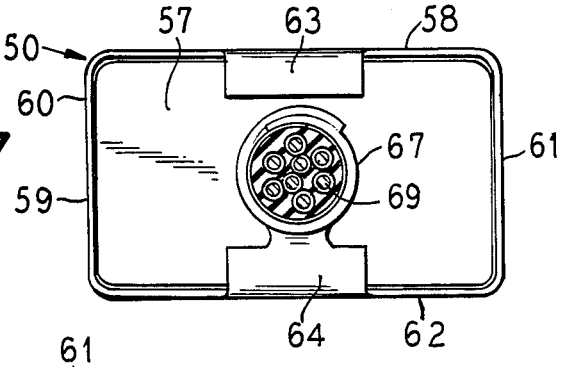
FIG. 7 is a rear view of the plug of FIG. 5.
Figure 8:
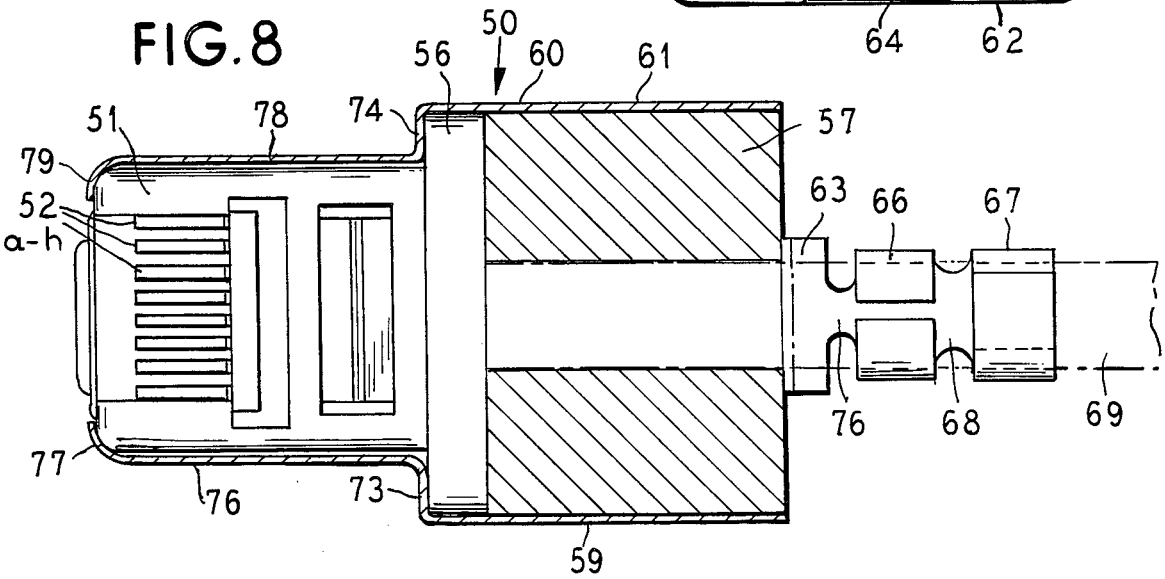
FIG. 8 is a top view of the plug of FIG. 6.

The plastic portion 51 has a shoulder 56 as shown in FIGS. 6 and 8. A metal housing 60 has a top wall 58 and a bottom wall 62 and sidewalls 59 and 61. The front portion of the metal housing 60 has a downwardly extending tab 72 and an upwardly extending tab 71 and inwardly extending tabs 73 and 74 as shown in FIGS. 5 and 8. The plastic plug can be inserted into the metal housing 60 such that the tabs 72, 71, 73 and 74 bear against the shoulder 56 and then a hollow ferrite sleeve 57 can be inserted into the housing 60 and rear tabs 63 and 64 can be bent down on the rear portion of the ferrite sleeve 57 so as to lock the assembly together. The metal housing 60 has forwardly extending portions 76 and 78 which extend along the sidewalls of the plastic plug member 51 and which have forward portions 77 and 79 which curve around and partially cover the front of the plastic plug portion 51 as shown in FIGS. 5 and 8. The rear portion of the metal housing 60 has a pair of cable engaging sleeves 66 and 67 which are connected to the tab 64 by a connecting portion 76 which connects the sleeve 66 to the tab 64 and a second portion 68 which connects the sleeve 66 to the sleeve 67. The sleeves 66 and 67 engage the metal grounded shield on a cable 69 so as to ground the housing 60 to the grounded shield of the cable 69. The purpose is to make one continuous ground from the cable shield to the female RJ jack including the metal housing.

Although the above description specifies that the plug is first inserted into, it is to be realized that the ferrite could first be inserted into the housing.

The plugs illustrated in FIGS. 1–8 are inserted into mating female receptacles which may have portions for engaging the housing 16 or 60 so as to assure grounding between the housings and the female receptacle.

Although the invention has been described with respect to preferred embodiments, it is not to be so limited as changes and modifications can be made which are within the full intended scope of the invention as defined by the appended claims.

I claim as my invention:

1. An electrical plug which is connectable to a cable and is adapted to be received into a female receptacle comprising, a plastic plug portion formed with electrical contacts formed on a first end, a pivoted latch attached to and forming a part of said plastic plug portion, a shoulder formed on a second end of said plastic plug portion, a hollow ferrite sleeve mounted with one end against said shoulder and the other end remote from said shoulder, and a metal electrically conducting housing received from the front connected face and with one end formed with a central opening at one end which is large enough to allow said electrical contacts to extend therethrough and small enough to prevent said shoulder from passing therethrough and completely enclosing said shoulder of said plastic plug portion and said hollow ferrite sleeve and the second end of said metal housing is formed at the rear with one ferrite sleeve retaining portion comprising an inturned flange which engages the remote end of said ferrite sleeve and also formed with a shield terminating portion which engages said cable.

* * * * *